US005174183A

United States Patent [19]

Werner

[11] Patent Number: 5,174,183

[45] Date of Patent: Dec. 29, 1992

[54] POST-CUTTING ARRANGEMENT FOR LOOPS

[75] Inventor: Roland Werner, Reutlingen, Fed. Rep. of Germany

[73] Assignee: Weda Roland Werner GmbH, Reutlingen, Fed. Rep. of Germany

[21] Appl. No.: 783,617

[22] Filed: Oct. 25, 1991

[30] Foreign Application Priority Data

Nov. 12, 1990 [DE] Fed. Rep. of Germany ..... 4035919

[51] Int. Cl.[5] ..... D26D 1/30; D06C 13/00

[52] U.S. Cl. ..... 83/176; 83/20; 83/100; 83/178; 83/599; 83/607; 83/936; 30/258; 30/304; 112/130

[58] Field of Search ..... 83/180, 188, 191, 902, 83/936, 607, 599, 178, 695, 176, 20, 21; 30/131, 133, 194, 289, 290, 256.1, DIG. 8, 279.2, 194, 244, 258, 304; 112/121.27, 130, 129

[56] References Cited

U.S. PATENT DOCUMENTS

| | | | |
|---|---|---|---|
| 974,118 | 11/1910 | Burke | 30/131 |
| 1,600,632 | 9/1926 | Hartsoe | 83/178 |
| 2,598,212 | 5/1952 | Blair | 30/133 |
| 2,659,141 | 11/1953 | Ludgewait | 30/131 |
| 3,606,681 | 9/1971 | Rogers et al. | 30/133 |
| 3,789,782 | 2/1974 | Speer | 112/130 |
| 4,035,913 | 7/1977 | Madl et al. | 30/304 X |
| 4,932,296 | 6/1990 | Boone | 83/607 X |

*Primary Examiner*—Frank T. Yost
*Assistant Examiner*—Clark F. Dexter
*Attorney, Agent, or Firm*—Michael J. Striker

[57] ABSTRACT

A post-cutting arrangement for sewing loops formed by a band portion has a mandrel provided for opening and spreading a loop, and having a gap for receiving free band ends, and at least one cutter arranged in the gap and movable relative to the band ends.

8 Claims, 1 Drawing Sheet

POST-CUTTING ARRANGEMENT FOR LOOPS

BACKGROUND OF THE INVENTION

The present invention relates to a post-cutting arrangement for finely sewn loops formed from a band portion, especially belt loops.

Belt loops and also ornamental loops on elements of clothes, especially pants and dresses are composed of portions of fabricated bands. The band portions are sewn at a distance from their ends on the lining piece. The loop ends of the sewn belt loops lie generally free and are overlapped by a belt, or continuously covered by the loop itself. In especially high grade dresses or pants one of the loop ends is displaced under a collar of the cloth article and thereby covered outwardly.

Normally there is no reason to cut off the free end of the sewn loop band portions afterwards. During the presently expanded post-treatment of the finally produced cloth articles, especially jean clothes, the free ends of the belt loops or other loops are frayed during post-washing under intensive mechanical loading of the cloth articles by stone, germs or leach. In this unprotected condition the loop band ends pull out and must be cut afterwards before the cloth article is to be sewn. This complicated work which also requires power in the case of strong loop band ends has been performed manually with scissors.

SUMMARY OF THE INVENTION

Accordingly, it is an object of the present invention to provide a post-cutting arrangement which avoids the disadvantages of the prior art.

More particularly, it is an object of the present invention to provide a post-cutting arrangement in which the free end portions of the sewn loops, especially belt loops, can be cut off fast and without difficulties.

In keeping with these objects and with others which will become apparent hereinafter, one feature of the present invention resides, briefly stated, in a post-cutting arrangement which has a mandrel for opening and spreading the loops and provided with a gap for receiving free loop band ends, and at least one cutter which is movably arranged in the gap and moves relative to a loop band end.

The sizes of the mandrel are adjusted to the size of the loops to be treated. With the post-cutting arrangement in accordance with the present invention the loops can be simply opened by an operator on the mandrel, immediately after placing the loop on the mandrel the free loop band ends move in the gap and then in the region of action of the cutter. The cutting step is performed by the operator with an easily actuatable switching device. The switching device can be for example a foot switch, or a hand switch which is automatically actuated by the hand of the operator which holds the cloth article during opening of the loop on the mandrel.

Advantageously the mandrel can be composed of a lower mandrel plate and an upper loop supporting plate. Both plates have a free tip and limit the receiving gap or loop band from above and from below. With the utilization of differently wide mandrel plates and loop supporting plates, the mandrel can be adjusted to the loops of different sizes. Advantageously the lower mandrel plate is formed as a stationary countercutter or a countercutter support. For this purpose it has at least one opening with an edge which forms a stationary countercutter edge or supports such a countercutter edge, for cooperating with the movable cutter or cutters in the gap.

The cutter can be formed in many different ways. For a compact construction and the adjustability of the mandrel to relatively small belt loops it is advantageous when a movable cutter support is formed by two pivoting cutter beams extending at a distance parallel to one another and pivotable about a common axis in the receiving gap to work as scissors.

The pivoting cutter beams can be coupled through an angel arm with a longitudinally movable drive ever. Each of the movable cutters is provided for one of two loop band ends. If only one free loop band end is available, only one cutter performs a working step, while the other cutter works on an idle. It is therefore not necessary to adjust the post-cutting arrangement to loops of one or two free loop band ends.

It is advantageous when the stationary counter-cutters are formed on the inner edge of a small side edge web of the lower mandrel plate. It is therefore ensured that the loop band ends can be cut close to the sewing point of the loop. The upper loop supporting plate can extend laterally to the cutting plane of a movable cutter. Therefore it is insured that the tensioned loop does not press on the turning pivoting cutter beams and the cutter cannot engage the loop band outside the free loop band ends.

The drive of the cutter can be designed in any manner. It is advantageous for driving of the cutter when a pneumatic or hydraulic cylinder-piston unit is utilized. The cut off loop band ends can be removed by a suction passage which ends above or below a recess or opening in the mandrel plate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
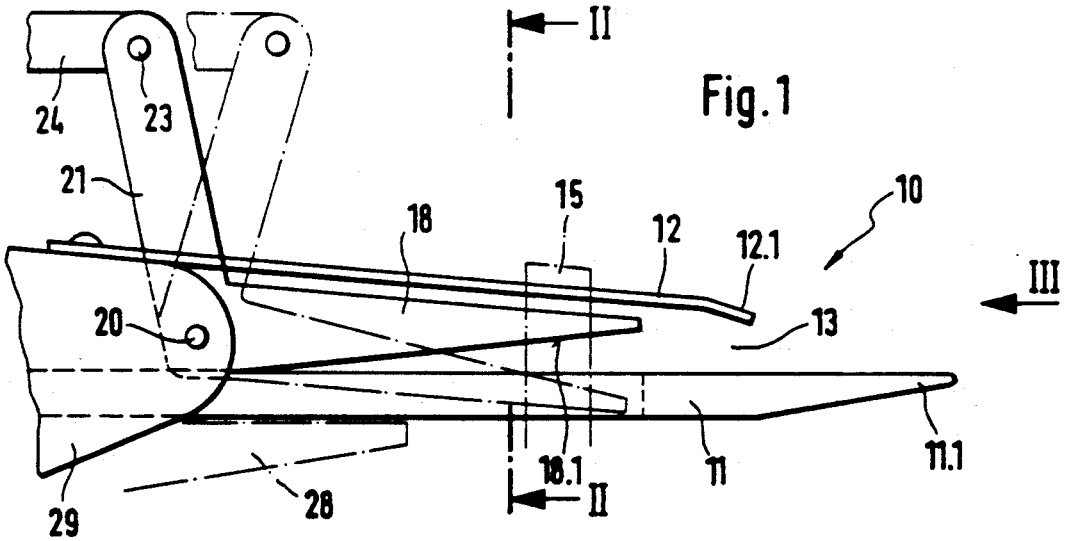
FIG. 1 is a side view of a post-cutting arrangement in accordance with the present invention with a mandrel for opening and spreading the loops and a cutting part.

An arrangement in accordance with the present invention has a mandrel which is identified with reference numeral 10 and is used for opening and spreading of loops. The mandrel 10 includes a lower mandrel plate 11 and an upper loop supporting plate 12. They limit from below and from above a receiving gap 13 for free ends 14 of a loop shown in FIG. 4. The loop has a band portion and is mounted on a lining piece 13 by seams 17. It is formed as a belt loop 15. The mandrel plate 11 and the loop supporting plate 12 both end in a free tip 11.1 and 12.1 respectively. The tip 11.1 of the lower mandrel plate 11 extends further forwardly than the tip 12.1 of the loop supporting plate 12.

Two pivoting cutter beams 18 and 19 are arranged at a distance and parallel to one another in the receiving gap 13. They have a cutting edge 18.1 shown in FIG. 1. In both sectional views of FIGS. *2a* and *2b*, both cutting blades are shown in section so that the inclined cutting edges can be seen. They can be formed by changeable blades in a not shown manner. Both pivoting cutter beams 18 and 19 are parts of an angle lever which is pivotable about a joint axis 20. The angle lever has angle arms 21 and 22 which extend upwardly through a not shown opening in the loop supporting plate 12. They are both coupled with a longitudinally movable drive lever 24 via a joint connecting axle 23 for joint operation. The longitudinally movable drive lever can be formed as a piston rod of a cylinder-piston unit 31.

Figure 2A:
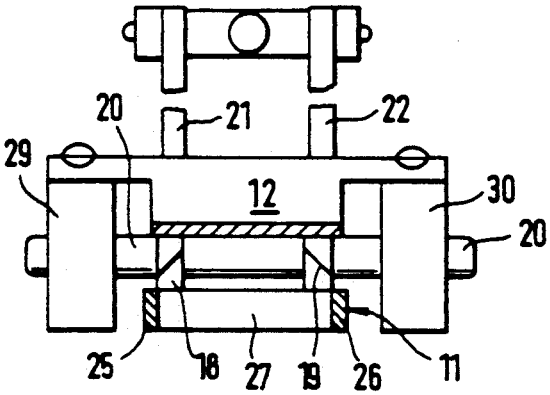
FIGS. 2*a*, 2*b* are views showing cross-sections of the mandrel with a cutter in its rest position and a cutter in its cutting position.
Figure 3:
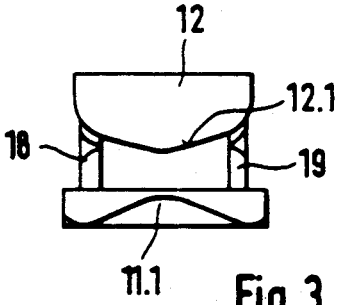
FIG. 3 is an end view of the mandrel of the inventive post-cutting device, as seen in direction of the arrow III in FIG. 1.
Figure 2B:
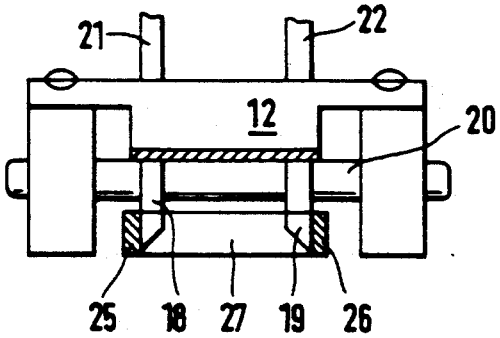

Both movable pivoting cutter beams 18 and 19 cooperate with stationary countercutter beams. The countercutter beams are formed by small lateral edge webs 25 and 26 of the mandrel plate 11 and limit a large throughgoing opening 27 of the lower mandrel plate 11. Cut off loop band ends 14 can fall downwardly through the throughgoing opening 27 and can be then aspirated in a negative pressure passage 28 which is shown in FIG. 1 and opens underneath the mandrel plate 11. The post-cutting device has a frame which supports both mandrel parts 11 and 12, the support for the movable cutting beams 18 and 19 and the drive device. Only two supporting arms 29 and 30 of the frame are shown in FIGS. 1 and 2.

Figure 4:
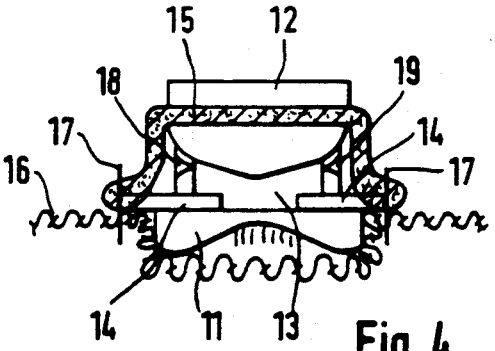
FIG. 4 is an end view of the mandrel of FIG. 3 with an open belt loop.
Figure 5:
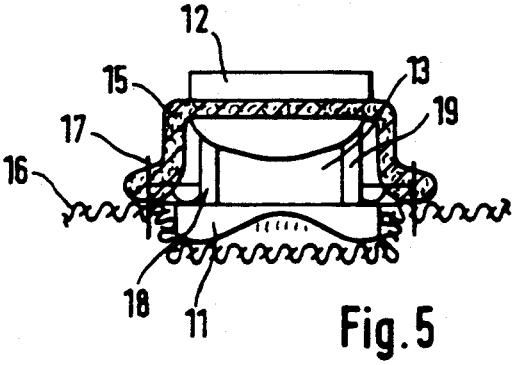
FIG. 5 is a view corresponding to the view of FIG. 4 with the cutter in a cutting position and separated loop ends.

In FIG. 1 the pivoting cutter beam 18 with its angle arm 21 is located in its rest position and shown in solid lines. This position corresponds to the showing of the section of FIG. *2a*. The operational position of the angular lever which forms the cutting beam 18 is shown in FIG. 1 in a broken line. It corresponds to the sectional view of FIG. *2b*. FIG. 4 shows the belt loop 15 which is located on the loop supporting plate 12 and also the free loop band end 14 extending in the receiving gap 13, with the pivoting cutter beams 18 and 19 located in the rest position analogous to the sectional view of FIG. *2a*. FIG. 5 shows an open belt loop 15 after cutting-off of the free loop band end 14, when the pivoting cutter beams 18 and 19 assume the operational position shown in FIG. *2b*. After the cutting off of the loop band end 14, the belt loop 15 is pulled by the operator from the mandrel opposite to the direction of the arrow III in FIG. 1, and a next band loop of the lining piece 16 to be post-cut is fitted on the mandrel 10.

It will be understood that each of the elements described above, or two or more together, may also find a useful application in other types of constructions differing from the types described above.

While the invention has been illustrated and described as embodied in a post-cutting arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A post-cutting arrangement for sewed loops formed by a band portion, comprising a mandrel slidable into the loop for opening and spreading it, said mandrel having a gap for receiving two free band ends of said sewed band portion forming said loop; and at least one movable cutter arranged in said gap of said mandrel and comprising two cutter beams having cutting edges thereon, said cutter beams arranged at a distance laterally spaced from and parallel to one another, one for each of said free band ends of said sewed band portion, said movable cutter being pivotable about a joint axis in said receiving gap wherein said joint axis extends transversely to said cutter beams.

2. A post-cutting arrangement as defined in claim 1, wherein said mandrel has a lower mandrel plate and an upper loop supporting plate, said plates having free tips and limiting from above and from below said receiving gap for the band ends.

3. A post-cutting arrangement as defined in claim 2, wherein said lower mandrel plate is provided with at least one opening having an edge which forms a stationary countercutter blade.

4. A post-cutting arrangement as defined in claim 2, wherein said lower mandrel plate has a small lateral edge web having an inner edge which forms a stationary countercutter blade.

5. A post-cutting arrangement as defined in claim 2, wherein said upper supporting plate extends laterally to a cutting plane of said movable cutter.

6. A post-cutting arrangement as defined in claim 1; and further comprising a longitudinally movable drive lever and an angle arm, said cutter beams being coupled through said angle arm with said longitudinally movable drive lever.

7. A post-cutting arrangement as defined in claim 1; and further comprising a drive connected with said cutter for driving said at least one cutter and including a pneumatic cylinder-piston unit.

8. A post-cutting arrangement as defined in claim 1; and further comprising a drive connected with said cutter for driving said at least one cutter and including a hydraulic cylinder-piston unit.

* * * * *